US005958641A

United States Patent [19]

Sano et al.

[11] Patent Number: 5,958,641

[45] Date of Patent: Sep. 28, 1999

[54] SINGLE COMPONENT TONER COMPRISING SPECIFIED POLYESTER

[75] Inventors: Tetsuo Sano, Amagasaki; Hiroyuki Fukuda, Kobe; Chikara Tsutsui, Nishinomiya; Choichiro Tanigawa; Senyu Taira, both of Itami; Mikihiko Sukeno, Ashiya, all of Japan

[73] Assignee: Minolta Co., Ltd., Osaka, Japan

[21] Appl. No.: 08/279,071

[22] Filed: Jul. 22, 1994

Related U.S. Application Data

[63] Continuation of application No. 07/707,786, May 30, 1991, abandoned.

[30] Foreign Application Priority Data

May 31, 1990 [JP] Japan ..... 2-143048
May 31, 1990 [JP] Japan ..... 2-143049

[51] Int. Cl.[6] ..... G03G 9/00

[52] U.S. Cl. ..... 430/110; 430/109

[58] Field of Search ..... 430/109, 110; 399/280, 272

[56] References Cited

U.S. PATENT DOCUMENTS

| | | | |
|---|---|---|---|
| 4,331,755 | 5/1982 | Gilliams et al. | 430/110 |
| 4,533,614 | 8/1985 | Fukumoto et al. | 430/99 |
| 4,533,617 | 8/1985 | Inoue et al. | 430/111 |
| 4,535,048 | 8/1985 | Inoue et al. | 430/110 |
| 4,833,057 | 5/1989 | Misawa et al. | 430/109 |
| 4,907,032 | 3/1990 | Enoguchi et al. | 399/280 |
| 4,988,794 | 1/1991 | Kubo et al. | 430/109 X |
| 5,098,811 | 3/1992 | Anno et al. | 430/109 |

FOREIGN PATENT DOCUMENTS

| | | |
|---|---|---|
| 0381896 | 8/1990 | European Pat. Off. . |
| 63-56659 | 3/1988 | Japan . |
| 3-31858 | 2/1991 | Japan . |

*Primary Examiner*—Maria Nuzzolillo
*Assistant Examiner*—Laura Weiner
*Attorney, Agent, or Firm*—Burns, Doane, Swecker & Mathis, LLP

[57] ABSTRACT

This invention relates to a single component toner comprising specified polyester resins as binder resin and used in single-component developing system in which toner particles are electrically charged when passing through the opening between a toner-levelling member and a toner-transporting member positioned against a photosensitive member.

13 Claims, 1 Drawing Sheet

SINGLE COMPONENT TONER COMPRISING SPECIFIED POLYESTER

This application is a continuation of application Ser. No. 07/707,786, filed May 30, 1991, now abandoned.

BACKGROUND OF THE INVENTION

This invention relates to a single component toner for developing electrostatic latent images in electrophotography, electrostatic recording, electrostatic printing and the like.

Electrostatic latent images can be made visible by single-component developer composed only of toner by means of normal development or reverse development to form copied images of high quality. Such a technique is disclosed in, for example, U.S. Pat. No. 3,731,146 and U.S. Pat. No. 2,811,465.

In single-component developing system, a toner levelling member (a blade) is pressed against a toner transporting member (a sleeve), toner particles pass through the space between the levelling blade and the sleeve to be charged electrically and a thin layer of charged toner particles is formed on the sleeve. It is required that the thin layer is formed stably on the sleeve to develop well electrostatic latent images formed on a photosensitive member.

With respect to the blade, an elastic blade formed of silicon rubber and the like is proposed to be pressed against the sleeve (as disclosed in U.S. Pat. No. 3,372,675, U.S. Pat. No. 3,426,730, JP Laid-Open 52-143831, JP Laid-Open 54-51848 and the like). Preferable blade is formed of rigid body such as SUS and the like from the viewpoints of prevention from wearing by toner particles and of linearity at the pressed portion on the photosensitive member so that more uniform thin layer of toner particles may be formed.

In either case where the elastic blade or the rigid blade is used, the toner particles are pressed at the toner levelling portion where the thin toner layer is formed, so that heat and stress are provided for the toner particles in single-component developing system. When a conventional toner formed of general styrene-acrylic resin is merely applied to the single-component developing system, toner particles deform plastically by stress caused by heat and pressure, so that the toner particles adhere to the blade and the sleeve. This phenomenon is inevitable in the single-component developing system. Such adherence of toner particles to the levelling member causes irregularity of toner thin layer, toner-providing failure and surface pollution of the developing sleeve. The adhered layer also causes deterioration of charging ability to result in irregular density of copied images, fogs on the copy ground and toner scattering.

On the other hand, an agent for fluidization, such as silica and the like, is generally added to toner in order to improve fluidity of a developer. When such a developer as containing the agent for fluidization is applied to single-component developing system, good fluidity is achieved at the beginning in repetition process because silica particles are merely adhered electrostatically to the surface of toner particles. However, the silica particles are buried into toner particles while the copying process is repeated, so that the fluidity is lost gradually.

Further, a toner formed of urethane-modified polyester resin is disclosed in, for example, JP Laid-Open 63-56659. The toner disclosed therein is applied to a two-component developer and provided to be fixed at high-speed and at low-temperature in the two-component developing system. However, the urethane-modified polyester resin is prepared at the small isocyanate usage, so that the chain-prolongation reaction does not proceed so much. The obtained polyester resin is low in polymerization degree and has such a molecular weight that insoluble component can not be obtained. The toner is completely different from that of the present invention in application field, object, properties of polyester resin and the like.

SUMMARY OF THE INVENTION

The object of the invention is to provide a toner excellent in resistance to stress and plastic deformation caused by heat and toner-levelling pressure at the portion where a toner thin layer is formed in single-component developing system in which toner particles are electrically charged when passing through the space between a toner transporting member and a toner levelling member.

The present invention relates to a toner comprising specified polyester resin and used in single-component developing system in which toner particles are electrically charged when passing through the space between the toner-levelling member and the toner-transporting member.

DETAILED DESCRIPTION OF THE INVENTION

Figure 1:
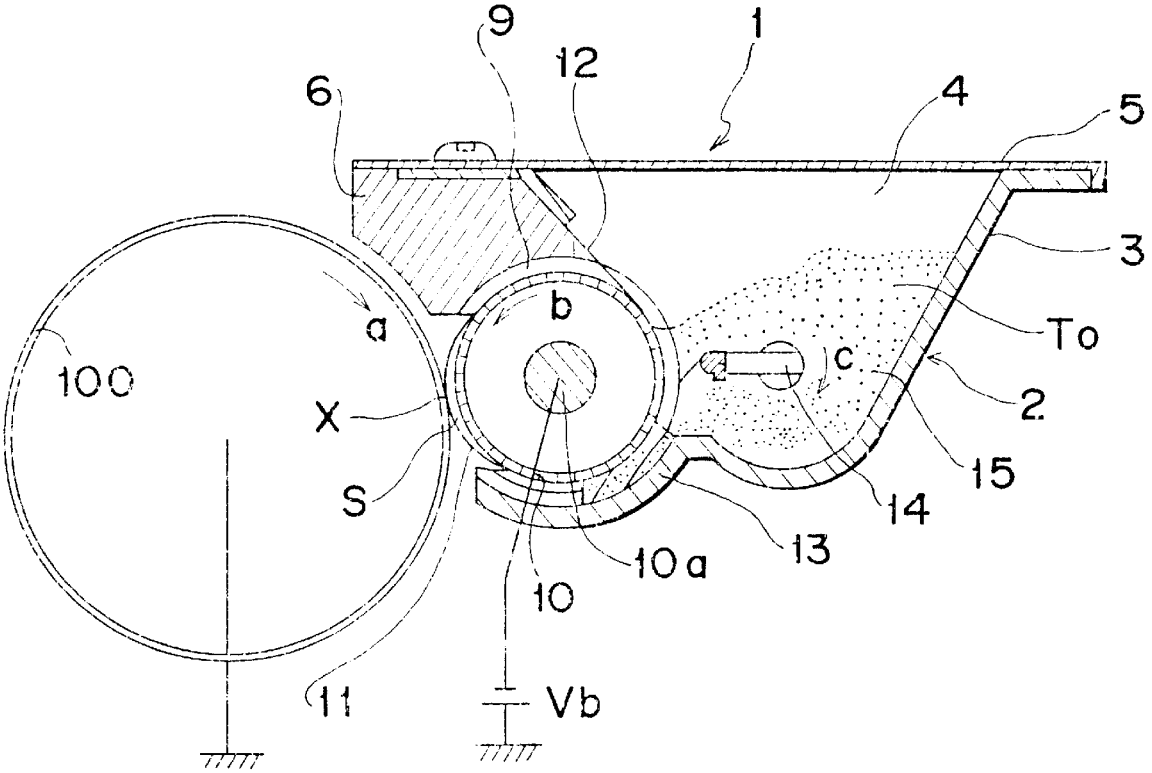
FIG. 1 shows a schematic sectional view of single component developing device.

The present invention provides a toner used in a single-component developing system in which toner particles are electrically charged stably to form a uniform thin layer of toner particles without adherence of toner particles at a toner-levelling portion and pollution of a toner transporting member (a sleeve) even though continuously or repeatedly used.

The present invention has accomplished the above object by forming a toner with a specified polyester resin prepared by at least linear polyester resin (A), polyester resin (B) for further polymerization and isocyanate.

The polyester resin component of the toner of the present invention is resistant to the stress given at the toner-levelling portion where a thin toner-layer is formed, and has durability, toughness such that the fixation of toner to a toner levelling member and the pollution of a developing sleeve are prevented, and thermal properties such that good fixing properties are obtained. The thermal properties are secured mainly by linear polyester (A) of low molecular weight and the toughness is secured by polyester resin (B) for further polymerization.

The linear polyester resin (A) is low molecular weight and composed of at least an etherified diphenol and an aromatic dicarboxylic acid.

The etherified diphenols, which are one of monomer components of the linear polyester (A) of low molecular weight, are exemplified by the ethoxified ones or the propoxified ones. The preferable ones are bisphenol A added by ethyleneoxide and bisphenol A added by propyleneoxide.

The aromatic dicarboxylic acids, which are the other monomer components of the linear polyester (A) of low molecular weight, are exemplified by phthalic acid, phthalic anhydride, isophthalic, and esters thereof.

Aliphatic dicarboxylic acids may be used at the same time. Such aliphatic dicarboxylic acids are exemplified preferably by aliphatic dibasic acids such as malonic acid, succinic acid, glutaric acid adipic acid, and azelaic acid, or aliphatic unsaturated dibasic acids such as maleic acid, maleic anhydride, fumaric acid, itaconic acid and citric acid.

Aliphatic diols may be used at the same time. Such aliphatic diols preferably exemplified by saturated or unsaturated aliphatic glycols such as ethylene glycol, 1,2-propylene glycol, 1,3-butylene glycol, 1,4-butylene glycol, 1,6-hexanediol, neopentyl glycol, diethylene glycol, dipropylene glycol, triethylene glycol.

The linear polyester (A) may be synthesized by a usual method in which at least above mentioned etherified diphenols and aromatic dicarboxy acids are mixed and polycondensed at high temperature, in solution or at interfacial phase.

The mixing ratio of etherified diphenols and dicarboxylic acid is adjusted so that the ratio of (carboxylic group)/(hydroxy group) may be 1.1~1.4, preferably 1.15~1.3. If the ratio is larger than 1.4, strength of resin is low, resulting in that toner is adhered to a blade and heat resistance of toner is deteriorated. If the ratio is smaller than 1.1, the softening point becomes high, resulting in deterioration of fixing strength of toner. When the aliphatic dicarboxylic acids are used, aromatic dicarboxylic acids are used so that the aromatic dicarboxylic acids may occupy 60 mole % or more, preferably 70 mole % or more on the basis of the total of dicarboxylic acids. Thereby, toner-fixing toughness can be given to toner. The linear polyester (A) is prepared to have physical properties such as molecular weight (weight-average molecular weight (Mw)) of 5000~12000, glass transition point (Tg) of 60~80° C. and acid value (Av) (KOH mg/g) of less than 45. If the weight average molecular weight is less than 5000, there arises a problem in toughness of the finally obtained polyester resin. If weight average molecular weight is higher than 12000, the softening point becomes high and toner-fixing strength is deteriorated. If the glass transition point is higher than 80° C., the finally obtained polyester resin becomes hard to be dissolved, and toner-fixing properties are deteriorated. If the glass transition point is lower than 60° C., the heat resistance of toner becomes poor. If the acid value is higher than 45, there arises a problem in humidity resistance.

The polyester resin (B) for further polymerization is prepared by polyols and/or aliphatic dicarboxy acids substituted by C3~C20 alkyl groups in addition to the same etherified diphenols and the same aromatic dicarboxylic acids as those used for the linear polyester resin (A) of low molecular weight.

With respect to polyols, one or more monomers are selected from aliphatic diols, polyols having three hydroxy groups or more and diols substituted by C3~C20 alkyl groups.

The aliphatic diols include saturated or unsaturated glycols such as ethylene glycol, 1,2-propylene glycol, 1,3-butylene glycol, 1,4-butylene glycol, 1,6-hexanediols neopentyl glycol, diethylene glycol, dipropylene glycol, triethylene glycol and the like.

The polyols having three hydroxy groups or more include glycerin, trimethylolpropane, triethylolethane, triethylolpropane, tributylolpropane, 2-methylpropenetriol, sorbitol, 1,2,3,6-hexanetetraol, 1,4-sorbitan, pentaerythritol, sucrose, and the like.

The diols substituted by C3~C20 alkyl group include dibutylhexanediol, dihexylhexane-diol, dioctylhexanediol, 1,4-dibutyl-1,4-butylene glycol, 1,4-dihexyl-1,4-butylene glycol, 1,6-dipropyl-1,6-hexanediol and the like.

The aliphatic dicarboxylic acids substituted by C3~C20 alkyl group are exemplified by alkyl group-substituted succinic acid such as butylsuccinic acid, hexylsuccinic acid, octylsuccinic acid, dodecylsuccinic acid and the like, alkyl group-substituted malonic acid, alkyl group-substituted glutaric acid, alkyl group-substituted adipic acid, alkyl group-substituted azelaic acid, alkyl group-substituted sebacic acid, alkyl group-substituted maleic acid, alkyl group-substituted maleic anhydride, alkyl group-substituted fumaric acid, alkyl group-substituted itaconic acid, alkyl group-substituted citraconic acid and the like.

The polyester for further polymerization is synthesized by mixing above mentioned monomer components so that the molar ratio (OH/COOH) of hydroxy group (OH) to carboxylic group (COOH) may be 1.1~1.4, followed by a usual polymerization method such as high-temperature polycondensation, solution polycondensation or interfacial polycondensation. If the ratio is larger than 1.4, strength of resin is low, resulting in that toner is adhered to a blade and resistance to toner off-set is deteriorated. The ratio of less than 1.1 is not preferred from productive viewpoint because the viscosity increases at reaction with polyisocyanate.

More preferably, molar ratio occupied by hydroxyl group of the polyols is 50 mole % or less, preferably 40 mole % or less on the basis of all hydroxyl groups. If the ratio is larger than 50 mole %, the amount of insoluble components of finally obtained polyester resin (C) increases, but the resin strength becomes so low to bring about toner adherence.

The same aliphatic dicarboxylic acids as those described above for preparation of linear polyester resin (A) of low molecular weight may be used as a component of the polyester resin (B) for further polymerization.

The polyester resin (B) for further polymerization is prepared so as to have molecular weight (weight average molecular weight (Mw)) of 5000~12000 and glass transition point (Tg) of 20~50° C. If the weight average molecular weight is smaller than 5000, the effects of reaction for chain prolongation can not be obtained satisfactorily. If the glass transition point is lower than 20° C., finally obtained polyester resin (C) comes to have much low glass transition point. If the glass transition point is higher than 50° C., finally obtained polyester resin comes to have high softening point and fixing properties and fixing strength are deteriorated. Moreover, the glass transition point of higher than 50° C. is not preferred from productive viewpoint because the viscosity increases at the time of reaction with polyisocyanate.

Then, the above obtained linear polyester resin (A) of low molecular weight and polyester resin (B) for further polymerization are mixed and treated for chain prolongation in the presence of isocyanates to prepare a polyester resin (C) as binder resin for toner. In this chain prolongation process, the chain prolongation occurs mainly in the polyester resin (B) for further polymerization. The linear polyester (A) of low molecular weight has excessive COOH groups, and the polyester (B) for further polymerization has excessive OH groups. Isocyanates react with OH 400 times faster than with COOH. Therefore, isocyanate groups react almost with the polyester (B) for further polymerization.

The chain-prolongation reaction is preferably carried out by mixing sufficiently and uniformly the linear polyester (A) and the polyester (B) under heat-molten conditions followed by reaction with isocyanates. It may be possible that both polyesters (A) and (B) are dissolved to react with isocyanates. However, the viscosity of solution increases as the reaction proceeds and it becomes hard to stir the solution. In order to avoid the hard stirring, the reaction should be carried out in a dilute solution, resulting in high production costs.

The polyester (A) and polyester (B) are mixed at weight ratio of 8:2~3:7, preferably 7:3~5:5. If the mixing ratio is not within the range as above mentioned, the prevention properties of toner from adhering to a blade or sleeve and fixing properties are not satisfactory.

Preferable isocyanates added to the mixture of the polyester (A) and the polyester (B) are hexamethylene isocyanate, isophorone diisocyanate, tolylene diisocyanate, diphenylmethane-4, 4'-diisocyanate, xylylene diisocyanate, tetramethylxylylene diisocyanate and the like.

The isocyanates are added so that molar ratio (NCO/OH) of isocyanate group (NCO) to hydroxy group(OH) contained in polyester (B) may be 0.8~1.5, preferably 1.0~1.3. The chain prolongation reaction is carried out so that the resultant polyester resin (C) may have physical properties such as glass transition point (Tg) of 60~80° C., softening point of 110° C.~170° C., insoluble components (gel components) of 10~40% by weight and acid value of 25 KOH mg/g or less. If the glass transition point is lower than 60° C. or if the softening point is lower than 110° C., finally obtained toner is poor in heat resistance and the toner is liable to adhere to toner levelling member. If the glass transition point is higher than 80° C. or if the softening point is higher than 170° C., resultant toner becomes poor in its fixing properties.

If the amount of insoluble components is larger than 40% by weight, resultant toner becomes poor in its fixing properties.

If its amount is smaller than 10% by weight, toner toughness becomes insufficient.

The reason why the acid value is suppressed below 25 KOH mg/g is to ensure environmental resistance of toner, in particular, humidity resistance.

In this invention, the glass transition point is measured by a differential scanning calorimeter and the softening point is measured by a flow tester. The amount of insoluble component is measured as below; Five grams of resin are put into methyl ethyl ketone of 50 ml and the mixture is stirred for 24 hours. After the obtained solution is filtered through the sieve having openings of 500 mesh, which is weighed in advance, the sieve is dried overnight in vacuum. Thus, the residual materials on the sieve are measured.

A toner of the present invention is obtained by mixing and kneading the above obtained polyester resin (C), and at least a colorant and, if desired, an off-set prevention agent, followed by pulverizing and classifying.

Polyolefin of low molecular weight is used as the off-set prevention agent. Preferable polyolefin is the one of oxidized type because it is in good compatibility with polyester resin, its fine particles can be dispersed and fixing properties are not influenced. Particularly preferable one is prepared by oxidative destruction of polyolefine of low molecular weight obtained by a decomposition method. Concretely, low molecular weight polypropylene wax of oxidized type (TS200; made by Sanyo Kasei K.K.), polyethylene wax of oxidized type (E-300, E-250; made by Sanyo Kasei K.K.) and the like may be used.

An addition amount of the off-set prevention agent is 1.0~5.0 parts by weight, preferably 2.0~4.0 parts by weight on the basis of 100 parts by weight of resin. If the amount is larger than 5.0 parts by weight, the adherence of toner particles occurs and fluidizing properties of developer are deteriorated. If the amount is smaller than 1.0 part by weight, off-set phenomenon occurs.

With respect to a colorant, conventional dye, pigment and the like may be used. Magnetic particles are exemplified by one kind of them.

If necessary, charge controlling agents (negatively chargeable agents which may contain metals or not, positively chargeable agent such as nigrosine series or triphenyl methane series), a fluidizing agent, a modifying agent (colloidal silica and the like), resin beads as a cleaning assistant (teflon, polyethylene, silicon, styrene resin, acrylic resin and the like) may be incorporated into a toner.

The toner as above mentioned is applied to, for example, a developing device for a single component developer shown in FIG. 1.

A developing device (1) adjoins a photoreceptor drum (100) driven rotatably in a direction as shown in an arrow (a).

In the developing device (1), a developer tank (2) is composed of a casing (3) disposed at the bottom and rear portions thereof, a couple of side plates (4), a cover (5) and a support member (6) rigidly secured to the forward portion of the cover (5).

A driving roller (10) is formed cylindrically and of an electrically conductive material such as aluminum, stainless steel or the like, with a developing bias voltage $V_b$ being applied thereto. Alternatively, the cylindrically formed driving roller (10) may be of a metallic roller provided, at its external peripheral portion, with an electrically conductive elastic member (nitrile rubber, silicone rubber, styrene rubber, butadiene rubber of the like).

A filmy member (11) (a toner transporting member) is formed also cylindrically and has a peripheral length slightly longer than that of the driving roller (10) so as to be loosely mounted therearound. As the filmy member (11), which has flexibility, is used either of a soft resinous sheet, for example, of polycarbonate, nylon, fluorine resin or the like, a sheet of such resin including carbon or metallic fine particles or the like, a metallic thin film of nickel, stainless steel, aluminum or the like, or a laminated sheet of the aforementioned resinous sheet and metallic thin film.

The driving roller (10) loosely mounting the filmy member (11) therearound is provided with a rotary shaft 10*a*, which is rotatably supported with a driving source (not shown) being drivingly connected to the rotary shaft 10*a*. At both end portions of the driving roller (10), an elastic guide pad (9) is interposed so that the filmy member (11) may be brought into close contact with the external surface of the driving roller (10). As the elastic guide pad (9) is used, for example, either of a material such as polyacetal, phenol resin, polyethylene, nylon, fluorine resin or the like, a member having a film of polyethylene, nylon, Teflon (trademark for tetra fluoroethylene fluorocarbon polymers used in trade and manufactured by Du Pont) or the like on its contact surface with the filmy member (11), or a foamed material having such film on its surface.

Accordingly, a portion of the filmy member (11) in contact, on its one side, with the guide pad (9) is brought into close contact, on its other side, with the external surface of the driving roller (10), and the other portion thereof is caused to protrude outwards so that a space (S) may be defined between the filmy member (11) and the driving roller (10). This is because an excessive peripheral portion of the filmy member (11) having the longer periphery than that of the driving roller (10) is collected. Consequently, the protruding portion of the filmy member (11) covering the space (S) is brought into contact, at its external surface, with the peripheral surface of the photoreceptor drum (100).

It is to be noted here that the guide pad (9), the developing roller (10) and the filmy member (11) are selected to satisfy a relationship of $\mu 1 > \mu 2$, where a dynamic coefficient of friction between the external surface of the driving roller (10) and the internal surface of the filmy member (11) is $\mu 1$, and that between the external surface of the filmy member (11) and the guide pad (9) is $\mu 2$.

Accordingly, when the driving roller (10) is caused to rotate in a direction as shown by an arrow (b), the filmy member (11) rotates together with the rotation of the driving roller (10) without any slip between the two and, the external surface of the filmy member (11) covering the space (S) is continuously kept in contact, through its suitable nip width, with the external surface of the photoreceptor drum (100) during the rotation of the two.

A blade (12) (a toner levelling member) having at its forward end, a flexible sheet, for example, of Teflon, nylon or the like is securely mounted on the rear side of the support member (6) provided immediately above the driving roller (10). The blade (12) resiliently presses the driving roller (10) through the filmy member (11) at an oblique upper portion on the rear side thereof. The blade (12) is of either of a springy metallic thin plate of SK-steel, stainless steel, phosphor bronze or the like, an elastic plate of silicone rubber, urethane rubber or the like, a resinous plate of fluorine resin, a nylon plate or the like. Furthermore, a compounded plate of such plates may be also used as the blade (12), on condition that it is distinct from the toner in electrostatic susceptibility.

A toner levelling pad (13) is mounted on a portion of the casing (3) of the developer tank (2) confronting the driving roller (10) and brought into indirect contact with the external surface thereof through the filmy member (11). The toner levelling pad (13) is of an elastic member formed, for example, of foamed urethane and covered with a silicone rubber sheet.

A toner storing compartment (15) is formed at the rear portion of the developer tank (2) and is internally provided with an agitator (14) disposed rotatably in a direction as shown by an arrow (c). The agitator (14) functions to agitate the toner (To) stored in the toner storing compartment (15) in a direction as shown by the arrow (c) for prevention of blocking thereof or the like.

The operation of the developing device (1) having the above described construction will be explained hereinafter.

On condition that the driving roller (10) and the agitator (14) are caused to rotate by a driving source (not shown) respectively in directions as shown by the arrows (b) and (c), the toner (To) accommodated within the toner storing compartment (15) is forcibly moved in a direction shown by the arrow (c) under an effect of stirring by the agitator (14).

Meanwhile, the filmy member (11) is driven to rotate in a direction as shown by the arrow (b) under the influence of frictional force exerting between it and the driving roller (10), thus resulting in that the toner (To) in contact with the filmy member (11) is transported in a direction of rotation of the filmy member (11) by the action of electrostatic force. When the toner (To) is caught in a V-shaped taking-in portion formed between the filmy member (11) and the forward portion of the blade (12), and reaches a pressure portion between the filmy member (11) and the blade (12), the toner (To) is spread uniformly in the form of a thin layer on the surface of the filmy member (11) and charged electrically through the friction therewith.

When the toner (To) held on the filmy member (11) under the influence of the electrostatic force, reaches a developing region (X) confronting the photoreceptor drum (100) in compliance with the movement of the filmy member (11) following the driving roller (10), the toner (To) is caused to adhere to an electrostatic latent image formed on the surface of the photoreceptor drum (100) to form a toner image in accordance with a voltage difference between a surface voltage of the photoreceptor drum (100) and the bias voltage applied to the driving roller (10).

Since the filmy member (11) in contact with the photoreceptor drum (100) is never brought into contact with the driving roller due to the existence of the space (S), the filmy member (11) softly and uniformly contact with the photoreceptor drum (100) through its suitable nip width so that the latent image formed on the photoreceptor drum (100) may be turned to the uniform toner image. In the case where a peripheral speed of the photoreceptor drum (100) is caused to differ from that of the filmy member (11), the toner image once formed on the photoreceptor drum (100) can never be broken.

The toner (To) having passed the developing region (X) is successively transported, together with the filmy member (11), in a direction as shown by the arrow (b). When the toner (To) passes between the toner levelling pad (13) and the filmy member (11), an image pattern from which the toner (To) has already been consumed in the developing region (X) is erased so that the uniformity of the toner layer may be obtained.

Consequently, the thin layer of the charged toner is uniformly formed again on the surface of the filmy member (11) at the pressure portion of the blade (12) and, the aforementioned operation is repeated thereafter.

EXAMPLE

Preparation Example of Polyester (A) of Low Molecular Weight

Polyol components and polycarboxylic acid components shown in Table 1 and Table 2 are placed in a four-necked 5-liter flask equipped with a condenser, a water-separation apparatus, a $N_2$ gas inlet pipe, a thermometer and a stirrer so that the ratio of COOH/OH might be adjusted as shown in Tables and the flask was set on a mantle heater. Then, dehydrating condensation polymerization was carried out at 220~270° C. while introducing $N_2$ gas into the flask, so that polyester resins of low molecular weight having characteristics (Mw, Tg) shown in Table 1 and Table 2 were obtained.

Preparation Example of Polyester (B) for Further Polymerization

Polyol components and polycarboxylic acid components shown in Table 3, Table 4 and Table 5 are placed in a four-necked 5-liter flask equipped with a condenser, a water-separation apparatus, a $N_2$ gas inlet pipe, a thermometer and a stirrer so that the ratio of COOH/OH might be adjusted as shown in Tables and the flask was set on a mantle heater. Then, dehydrating condensation polymerization was carried out at 240° C. while introducing $N_2$ gas into the flask, so that polyester resins for further polymerization having characteristics (Mw, Tg) shown in Tables 3~5 were obtained.

Preparation of Binder Resin for Toner by Chain Prolongation Reaction of Polyester Resin of Low Molecular Weight and Polyester Resin for Further Polymerization The polyester resins of low molecular weight and the polyester resins for further polymerization were put into Henschel mixer as shown in Tables 6–10 to be blended in dry condition. After uniformly blended, the mixture was put into a heating kneader.

Polyisocyanates shown in Tables 6~10 were charged so that the ratios of NCO/OH shown in Tables might be obtained.

The reaction was carried out at 120° C. for one hour.

After it was confirmed that there was almost no residual isocyanates by measuring NCO %, the reaction system was cooled to obtain polyester resins having urethane bonds so shown in Tables 6~10.

Insolubles(%), glass transition point (Tg) and softening point of resultant polyester resins were shown in Tables 6~10.

TABLE 1

| Polyester of low molecular weight | i | ii | iii |
|---|---|---|---|
| adduct of propylene oxide with bisphenol | 1376 | 1376 | 1376 |
| isophthalic acid | 443 | 472 | 553 |
| COOH/OH | 1.5 | 1.4 | 1.2 |

TABLE 1-continued

| Polyester of low molecular weight | i | ii | iii |
|---|---|---|---|
| Mw | 4000 | 5000 | 10000 |
| Tg | 58 | 61 | 76 |

TABLE 2

| Polyester of low molecular weight | iv | v | vi | vii | viii |
|---|---|---|---|---|---|
| adduct of propylene oxide with bisphenol | 1376 | 1376 | 1376 | 1376 | 1376 |
| isophthalic acid | 664 | 498 | 332 | 277 | 398 |
| succinic acid | | 39.3 | 157 | 197 | 113 |
| diethylene glycol | 85 | | | | 85 |
| COOH/OH | 1.2 | 1.2 | 1.2 | 1.2 | 1.2 |
| Mw | 9600 | 9000 | 8000 | 7800 | 8000 |
| Tg | 70 | 65 | 61 | 58 | 60 |

TABLE 3

| Polyester for further polymerization | I | II | III | IV | V | VI |
|---|---|---|---|---|---|---|
| adduct of propylene oxide with bisphenol | 1720 | 1720 | 1720 | 1720 | 1720 | 1720 |
| isophthalic acid | 860 | 860 | 1028 | 860 | 755 | 760 |
| succinic acid | | | | 119 | | |
| diethylene glycol | 129 | | 129 | 129 | 145 | 198 |
| glycerin | | 74.6 | 74.6 | 74.6 | | |
| OH/COOH | 1.2 | 1.2 | 1.2 | 1.2 | 1.4 | 1.5 |
| Mw | 7000 | 6800 | 7100 | 7000 | 5000 | 4600 |
| Tg | 40 | 39 | 41 | 42 | 20 | 16 |

TABLE 4

| Polyester for further polymerization | VII | VIII | IX | X |
|---|---|---|---|---|
| adduct of propylene oxide with bisphenol | 1376 | 1376 | 1376 | 1376 |
| isophthalic acid | 1017 | 1017 | 1017 | 1017 |
| diethylene glycol | 424 | 339 | 53 | 0 |
| glycerin | 0 | 49 | 215 | 245 |
| OH/COOH | 1.2 | 1.2 | 1.2 | 1.2 |
| Mw | 6000 | 5800 | 5100 | 4500 |
| Tg | 30 | 27 | 21 | 18 |

TABLE 5

| Polyester for further polymerization | XI | XII | XIII | XIV |
|---|---|---|---|---|
| adduct of propylene oxide with bisphenol | 1720 | 1720 | 1720 | 1720 |
| isophthalic acid | 860 | 1028 | 860 | 720 |
| dodecenyl succinate | 266 | | 266 | 189 |
| diethylene glycol | 129 | | | 129 |
| 1,6-dipropyl-1,6-hexanediol | | 328 | 328 | |
| glycerin | 74.6 | 74.6 | 74.6 | |
| OH/COOH | 1.2 | 1.2 | 1.2 | 1.2 |
| Mw | 7100 | 6800 | 6900 | 7100 |
| Tg | 41 | 38 | 39 | 45 |

TABLE 6

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| polyester resin of | ii | ii | ii | ii | ii | ii | i | iii | ii | ii | ii | ii | ii | ii | ii | ii |
| low molecular weight (× 70 parts by weight) | 60 | 60 | 60 | 60 | 60 | 60 | 60 | 60 | 90 | 80 | 30 | 20 | 60 | 60 | 60 | 60 |
| polyester resin for | I | II | III | IV | V | VI | IV | IV | IV | IV | IV | IV | IV | IV | IV | IV |
| further polymerization (× 70 parts by weight) | 40 | 40 | 40 | 40 | 40 | 40 | 40 | 40 | 10 | 20 | 70 | 80 | 40 | 40 | 40 | 40 |
| MDI parts by weight* | 100 | 103 | 99 | 100 | 140 | 152 | 100 | 100 | 25 | 50 | 175 | 200 | 70 | 80 | 150 | 160 |
| NCO/OH | 1.0 | 1.0 | 1.0 | 1.0 | 1.0 | 1.0 | 1.0 | 1.0 | 1.0 | 1.0 | 1.0 | 1.0 | 0.7 | 0.8 | 1.5 | 1.6 |
| insolubles (%) | 20 | 20 | 20 | 20 | 20 | 15 | 10 | 25 | 0.2 | 10 | 25 | 30 | 8 | 15 | 40 | 50 |
| Tg (° C.) | 65 | 67 | 64 | 65 | 63 | 60 | 55 | 70 | 58 | 60 | 70 | 80 | 58 | 62 | 75 | 81 |
| softening point (° C.) | 140 | 148 | 134 | 140 | 128 | 110 | 100 | 152 | 108 | 110 | 152 | 100 | 108 | 120 | 160 | 172 |
| Av | 25 | 25 | 25 | 25 | 25 | 25 | 30 | 20 | 37.5 | 33 | 12.5 | 8 | 25 | 25 | 25 | 25 |
| adhering properties | ○ | ○ | ○ | ○ | Δ | X | X | ○ | X | Δ | ○ | ○ | X | ○ | ○ | ○ |
| heat resistance | ○ | ○ | ○ | ○ | ○ | ○ | X | ○ | X | ○ | ○ | ○ | X | ○ | ○ | ○ |
| off-set resistance | ○ | ○ | ○ | ○ | ○ | ○ | Δ | ○ | X | ○ | ○ | ○ | X | ○ | ○ | ○ |
| fixing strength | ○ | ○ | ○ | ○ | ○ | ○ | ○ | ○ | ○ | ○ | ○ | X | ○ | ○ | ○ | X |
| total evaluation | ○ | ○ | ○ | ○ | ○ | X | X | ○ | X | ○ | ○ | X | X | ○ | ○ | X |

MDI: diphenylmethane-4,4-diisocyanate

TABLE 7

| | 17 | 18 | 19 | 20 | 21 | 22 | 23 | 24 | 25 | 26 | 27 | 28 | 29 | 30 | 31 | 32 | 33 | 34 |
|---|---|---|---|---|---|---|---|---|---|---|---|---|---|---|---|---|---|---|
| polyester resin of | viii | viii | viii | viii | viii | viii | iv | v | vi | vii | viii | viii | viii | viii | viii | viii | viii | viii |
| low molecular weight (× 70 parts by weight) | 60 | 60 | 60 | 60 | 60 | 60 | 60 | 60 | 60 | 60 | 90 | 80 | 30 | 20 | 60 | 60 | 60 | 60 |
| polyester resin for | I | II | III | IV | V | VI | IV | IV | IV | IV | IV | IV | IV | IV | IV | IV | IV | IV |
| further polymerization (× 70 parts by weight) | 40 | 40 | 40 | 40 | 40 | 40 | 40 | 40 | 40 | 40 | 10 | 20 | 70 | 80 | 40 | 40 | 40 | 40 |
| MDI parts by weight* | 100 | 103 | 99 | 100 | 140 | 152 | 100 | 100 | 100 | 100 | 25 | 50 | 175 | 200 | 70 | 80 | 150 | 160 |
| NCO/OH | 1.0 | 1.0 | 1.0 | 1.0 | 1.0 | 1.0 | 1.0 | 1.0 | 1.0 | 1.0 | 1.0 | 1.0 | 1.0 | 1.0 | 0.7 | 0.8 | 1.5 | 1.6 |
| insolubles (%) | 20 | 20 | 20 | 20 | 20 | 15 | 25 | 25 | 20 | 18 | 0.2 | 10 | 25 | 40 | 8 | 15 | 40 | 50 |
| Tg (° C.) | 65 | 67 | 64 | 65 | 63 | 60 | 69 | 67 | 66 | 58 | 58 | 60 | 70 | 80 | 56 | 61 | 75 | 82 |
| softening point (° C.) | 140 | 148 | 135 | 140 | 130 | 109 | 150 | 148 | 145 | 108 | 109 | 110 | 152 | 160 | 107 | 112 | 154 | 162 |
| Av | 20 | 20 | 20 | 20 | 20 | 20 | 15 | 18 | 19 | 30 | 30 | 25 | 10 | 6 | 20 | 20 | 20 | 20 |
| adhering properties | ○ | ○ | ○ | ○ | ○ | X | ○ | ○ | ○ | Δ | X | ○ | ○ | ○ | X | ○ | ○ | ○ |
| heat resistance | ○ | ○ | ○ | ○ | ○ | ○ | ○ | ○ | ○ | X | X | ○ | ○ | ○ | X | ○ | ○ | ○ |
| off-set resistance | ○ | ○ | ○ | ○ | ○ | ○ | ○ | ○ | ○ | Δ | X | Δ | ○ | ○ | X | Δ | ○ | ○ |
| fixing strength | ○ | ○ | ○ | ○ | ○ | ○ | ○ | ○ | ○ | ○ | ○ | ○ | ○ | X | ○ | ○ | ○ | X |
| total evaluation | ○ | ○ | ○ | ○ | ○ | X | ○ | ○ | ○ | X | X | ○ | ○ | X | X | ○ | ○ | X |

*MDI: diphenylmethane-4,4-diisocyanate

TABLE 8

| | | | | | | | | | | | | | | |
|---|---|---|---|---|---|---|---|---|---|---|---|---|---|---|
| polyester resin of | ii | ii | ii | ii | i | iii | ii | ii | ii | ii | ii | ii | ii | ii |
| low molecular weight (× 70 parts by weight) | 60 | 60 | 60 | 60 | 60 | 60 | 90 | 80 | 30 | 20 | 60 | 60 | 60 | 60 |
| polyester resin for | VII | VIII | IX | X | VIII | VIII | VIII | VIII | VIII | VIII | VIII | VIII | VIII | VIII |
| further polymerization (× 70 parts by weight) | 40 | 40 | 40 | 40 | 40 | 40 | 10 | 20 | 70 | 80 | 40 | 40 | 40 | 40 |
| MDI parts by weight* | 117 | 120 | 137 | 155 | 120 | 120 | 30 | 60 | 210 | 240 | 84 | 96 | 180 | 192 |
| NCO/OH | 1.0 | 1.0 | 1.0 | 1.0 | 1.0 | 1.0 | 1.0 | 1.0 | 1.0 | 1.0 | 0.7 | 0.8 | 1.5 | 1.6 |
| insolubles (%) | 10 | 15 | 30 | 35 | 8 | 20 | 6 | 10 | 35 | 45 | 8 | 10 | 30 | 50 |
| Tg (° C.) | 68 | 69 | 70 | 72 | 65 | 75 | 64 | 66 | 72 | 74 | 65 | 68 | 72 | 76 |
| softening point (° C.) | 144 | 145 | 147 | 148 | 140 | 152 | 138 | 140 | 155 | 160 | 140 | 144 | 150 | 162 |
| heat resistance | ○ | ○ | ○ | ○ | ○ | ○ | ○ | ○ | ○ | ○ | ○ | ○ | ○ | ○ |
| adhering properties | ○ | ○ | ○ | X | X | ○ | X | Δ | ○ | ○ | Δ | ○ | ○ | ○ |
| fixing strength | ○ | ○ | ○ | ○ | ○ | ○ | ○ | ○ | ○ | X | ○ | ○ | ○ | X |
| off-set resistance | ○ | ○ | ○ | ○ | X | ○ | X | ○ | ○ | ○ | X | ○ | ○ | ○ |
| total evaluation | ○ | ○ | ○ | X | X | ○ | X | ○ | ○ | X | X | ○ | ○ | X |

*MDI: diphenylmethane-4,4-diisocyanate

TABLE 9

| | | | | | | | | | | | | | | | | |
|---|---|---|---|---|---|---|---|---|---|---|---|---|---|---|---|---|
| polyester resin of | viii | viii | viii | iv | v | vi | vii | viii | viii | viii | viii | viii | viii | viii | viii | viii |
| low molecular weight (× 70 parts by weight) | 60 | 60 | 60 | 60 | 60 | 60 | 60 | 90 | 80 | 30 | 20 | 60 | 60 | 60 | 60 | 60 |
| polyester resin for further polymerization (× 70 parts by weight) | XI 40 | XII 40 | XIII 40 | XIII 40 | XIII 40 | XIII 40 | XIII 40 | XIII 10 | XIII 20 | XIII 70 | XIII 80 | XIII 40 | XIII 40 | XIII 40 | XIII 40 | XIV 40 |
| MDI parts by weight* | 99 | 102 | 101 | 101 | 101 | 101 | 101 | 20 | 50 | 176 | 202 | 71 | 81 | 152 | 162 | 99 |
| NCO/OH | 1.0 | 1.0 | 1.0 | 1.0 | 1.0 | 1.0 | 1.0 | 1.0 | 1.0 | 1.0 | 1.0 | 0.7 | 0.8 | 1.5 | 1.6 | 1.0 |
| insolubles (%) | 20 | 20 | 20 | 35 | 30 | 25 | 17 | 0.2 | 10 | 25 | 40 | 8 | 15 | 40 | 50 | 20 |
| Tg (° C.) | 64 | 60 | 63 | 72 | 70 | 65 | 58 | 56 | 60 | 68 | 75 | 54 | 60 | 73 | 80 | 66 |
| softening point (° C.) | 135 | 130 | 132 | 150 | 148 | 146 | 130 | 110 | 111 | 148 | 155 | 107 | 130 | 150 | 160 | 138 |
| Av | 20 | 20 | 20 | 15 | 18 | 19 | 30 | 30 | 25 | 10 | 6 | 20 | 20 | 20 | 20 | 20 |
| adhering properties | ○ | Δ | ○ | ○ | ○ | ○ | X | X | Δ | ○ | ○ | X | ○ | ○ | ○ | ○ |
| heat resistance | ○ | ○ | ○ | ○ | ○ | ○ | X | X | ○ | ○ | ○ | X | ○ | ○ | ○ | ○ |
| off-set resistance | ○ | ○ | ○ | ○ | ○ | ○ | X | X | ○ | ○ | ○ | Δ | ○ | ○ | ○ | ○ |
| fixing strength | ○ | ○ | ○ | ○ | ○ | ○ | ○ | X | ○ | ○ | X | ○ | ○ | ○ | X | ○ |
| total evaluation | ○ | ○ | ○ | ○ | ○ | ○ | X | X | ○ | ○ | X | X | ○ | ○ | X | ○ |

*MDI: diphenylmethane-4,4-diisocyanate

TABLE 10

| | | | | | | | | | | | | | |
|---|---|---|---|---|---|---|---|---|---|---|---|---|---|
| polyester resin of | ii | ii | ii | i | iii | ii | ii | ii | ii | ii | ii | ii | ii |
| low molecular weight (× 70 parts by weight) | 60 | 60 | 60 | 60 | 60 | 90 | 80 | 30 | 20 | 60 | 60 | 60 | 60 |
| polyester resin for further polymerization (× 70 parts by weight) | XI 40 | XII 40 | XIII 40 | XIII 40 | XIII 40 | XIII 10 | XIII 20 | XIII 70 | XIII 80 | XIII 40 | XIII 40 | XIII 40 | XIII 40 |
| MDI parts by weight* | 99 | 102 | 101 | 101 | 101 | 25 | 50 | 175 | 200 | 71 | 81 | 152 | 162 |
| NCO/OH | 1.0 | 1.0 | 1.0 | 1.0 | 1.0 | 1.0 | 1.0 | 1.0 | 1.0 | 0.7 | 0.8 | 1.5 | 1.6 |
| insolubles (%) | 20 | 20 | 20 | 10 | 25 | 0.2 | 10 | 25 | 40 | 8 | 15 | 40 | 50 |
| Tg (° C.) | 66 | 65 | 63 | 58 | 75 | 54 | 60 | 70 | 82 | 59 | 61 | 78 | 86 |
| softening point (° C.) | 128 | 125 | 120 | 108 | 160 | 100 | 112 | 150 | 168 | 108 | 113 | 162 | 173 |
| Av | 25 | 25 | 25 | 30 | 20 | 38 | 32 | 12.5 | 8 | 25 | 25 | 25 | 25 |
| adhering properties | ○ | ○ | ○ | X | ○ | X | ○ | ○ | ○ | Δ | ○ | ○ | ○ |
| heat resistance | ○ | ○ | ○ | X | ○ | X | Δ | ○ | ○ | X | ○ | ○ | ○ |
| off-set resistance | ○ | ○ | ○ | ○ | ○ | X | ○ | ○ | ○ | Δ | ○ | ○ | ○ |
| fixing strength | ○ | ○ | ○ | ○ | Δ | ○ | ○ | ○ | X | ○ | ○ | ○ | X |
| total evaluation | ○ | ○ | ○ | X | ○ | X | ○ | ○ | X | X | ○ | ○ | X |

*MDI: diphenylmethane-4,4-diisocyanate

Preparation of Toner

Polyester resins obtaiped in Preparation of Binder Resin of Toner (shown in Tables 6~10) were used. The polyester resin of 100 parts by weight, carbon black of 10 parts by weight, charge controlling agent (Spilon Black TRH; made by Hodogaya Kagaku K.K.) of 3 parts by weight, polyolefin of low molecular weight (TS200; made by Sanyo Kasei K.K.) of 3 parts by weight were mixed in Henschel mixer. The obtained mixture was kneaded in 2-axial extruder. After cooling, the kneaded mixture was pulverized coarsely and further pulverized finely in a jet mil. The obtained particles were classified by air-classifier to obtain toner particles having mean particle size of 10 μm (5 μm or less: 0%, 20 μm or more: 0%).

The resultant toners were set in the single-component developing device shown in FIG. 1. The driving conditions were as follows;

developing sleeve (11)
- thin member of nickel prepared by an electroforming method.
- thickness of 35 μm
- surface roughness of 2 μm
- peripheral speed of 105 mm/sec.

toner levelling blade (12)
- pressure of about 5 g/mm$^2$ against the developing sleeve (11)
- toner layer of 20~30 μm The developing device was installed in an electrophotographic printer (35 mm/sec in system speed) to evaluate adhering properties, heat resistance, off-set resistance and fixing speed, and characteristics thereof were also totally evaluated. The results were shown in Tables 6~10.

Adhering properties:

Toner particles were put into the developing device of FIG. 1 (the photoreceptor was not installed). The sleeve (the filmy member (11)) was rotated continuously for 30 hours. When the toner particles adhered to the blade (12), white lines were formed on the sleeve. The symbol "X" shows white lines were formed. The symbol "○" shows no white lines were formed. The symbol "Δ" shows a little white lines were formed.

Heat resistance

Toner particles of 5 g were put into glass bottle and left at 30° C. for 24 hours.

The symbol "X" shows toner aggregation was observed.

The symbol "○" shows toner aggregation was not observed.

Off-set resistance:

Off-set was evaluated visually.

The symbol "X" shows off-set phenomenon was remarkable.

The symbol "Δ" shows off-set phenomenon was observed a little.

The symbol "○" shows no off-set phenomenon was observed.

Fixing strength

Eraser test was carried out.

The symbol "○" shows portions having ID of 1.2 or more occupied 85% or more.

The symbol "X" shows portions having ID of 1.2 or more occupied less than 85%

Total evaluation

Adhering properties, heat resistance, off-set resistance and fixing strength were evaluated totally to be ranked as below;

The symbol "○" shows all evaluation items were evaluated as "○", or only one of evaluation items was evaluated as "Δ", and the other evaluation items were evaluated as "○".

The symbol "X" shows at least one of evaluation items was evaluated as "X", or at least two of evaluation items were evaluated as "Δ".

What is claimed is:

1. A single-component toner comprising:

a binder resin comprising linear polyester resin (A) and polyester resin (B) bonded with urethane bonds, and a colorant, said linear polyester resin (A) composed of at least an etherified diphenol and an aromatic dicarboxylic acid, and having a weight average molecular weight of 5000 to 12000, a glass transition point of 60 to 80° C., an acid value of 45 KOHmg/g or less and a molar ratio (carboxyl group/hydroxyl group) of 1.1 to 1.4;

said polyester resin (B) composed of at least an etherified diphenol, an aromatic dicarboxylic acid, and at least one compound selected from the group consisting of aliphatic diols, polyols having three hydroxyl groups or more, aliphatic dicarboxylic acids substituted by $C_3$–$C_{20}$ alkyl group and diols substituted by $C_3$–$C_{20}$ alkyl group, and having a molar ratio (hydroxyl group/carboxyl group) of 1.1 to 1.4, a weight average molecular weight of 5000 to 12000 and a glass transition point of 20 to 50° C.; and said binder resin prepared by mixing the linear polyester resin (A) and the polyester resin (B) which differs from the linear polyester resin (A) and treating the obtained mixture with an isocyanate compound to form said urethane bonds for chain prolongation.

2. The toner of claim 1, wherein said polyester resin (A) is mixed with said polyester resin (B) at a weight ratio of 8:2 to 3:7.

3. The toner of claim 1, wherein said isocyanate compound and said polyester resin (B) have a molar ratio (NCO/OH) of 0.8 to 1.5 of isocyanate group (NCO) of said isocyanate compound to hydroxyl group (OH) of said polyester resin (B).

4. The toner of claim 1, wherein said toner further comprises an off-set prevention agent.

5. The toner of claim 4, wherein said off-set prevention agent is an oxidized polyolefin.

6. The toner of claim 5, wherein said oxidized polyolefin is an oxidized polypropylene.

7. The toner of claim 1, wherein said binder resin has a glass transition point of 60 to 80° C. and a softening point of 110 to 170° C. and contains an insoluble component which is insoluble in methyl ethyl ketone at a content of 10 to 40 percent by weight.

8. The toner of claim 1, wherein said binder resin has an acid value of 25 KOHmg/g or less.

9. A single-component toner comprising:

a binder resin comprising a linear polyester resin (A) and a polyester resin (B) bonded with urethane bonds, and a colorant, said linear polyester resin (A) having a molar ratio (carboxyl group/hydroxyl group) of 1.1 to 1.4, a weight average molecular weight of 5000 to 12000, a glass transition point of 60 to 80° C. and an acid value of 45 KOHmg/g or less, said polyester resin (B) having a molar ratio (hydroxyl group/carboxyl group) of 1.1 to 1.4, a weight average molecular weight of 5000 to 12000 and a glass transition point of 20 to 50° C.; and said binder resin prepared by mixing the linear polyester resin (A) and the polyester resin (B) which differs from the linear polyester resin (A) and treating the obtained mixture with an isocyanate compound to form said urethane bonds, wherein said toner further comprises an off-set prevention agent.

10. The toner of claim 9, wherein said off-set prevention agent is an oxidized polyolefin.

11. The toner of claim 10, wherein said oxidized polyolefin is an oxidized polypropylene.

12. A single-component toner comprising:

a binder resin comprising a linear polyester resin (A) and a polyester resin (B) bonded with urethane bonds, and a colorant, said linear polyester resin (A) having a molar ratio (carboxyl group/hydroxyl group) of 1.1 to 1.4, a weight average molecular weight of 5000 to 12000, a glass transition point of 60 to 80° C. and an acid value of 45 KOHmg/g or less, said polyester resin (B) having a molar ratio (hydroxyl group/carboxyl group) of 1.1 to 1.4, a weight average molecular weight of 5000 to 12000 and a glass transition point of 20 to 50° C.; and said binder resin prepared by mixing the linear polyester resin (A) and the, polyester resin (B) which differs from the linear polyester resin (A) and treating the obtained mixture with an isocyanate compound to form said urethane bonds, wherein said binder resin has a glass transition point of 60 to 80° C. and a softening point of 110 to 170° C. and contains an insoluble component which is insoluble in methyl ethyl ketone at a content of 10 to 40 percent by weight.

13. A single-component toner comprising:

a binder resin comprising a linear polyester resin (A) and a polyester resin (B) bonded with urethane bonds, and a colorant, said linear polyester resin (A) having a molar ratio (carboxyl group/hydroxyl group) of 1.1 to 1.4, a weight average molecular weight of 5000 to 12000, a glass transition point of 60 to 80° C. and an acid value of 45 KOHmg/g or less, said polyester resin (B) having a molar ratio (hydroxyl group/carboxyl group) of 1.1 to 1.4, a weight average molecular weight of 5000 to 12000 and a glass transition point of 20 to 50° C.; and said binder resin prepared by mixing the linear polyester resin (A) and the polyester resin (B) which differs from the linear polyester resin (A) and treating the obtained mixture with an isocyanate compound to form said urethane bonds, wherein said binder resin has an acid value of 25 KOHmg/g or less.

* * * * *